United States Patent [19]

Adams, Jr. et al.

[11] 3,974,419

[45] Aug. 10, 1976

[54] ELECTRONIC FLASH APPARATUS WITH INHIBITION OF CONTACT BOUNCE FALSE TRIGGERING

[75] Inventors: James R. Adams, Jr.; Dennis J. Wilwerding, both of Littleton, Colo.

[73] Assignee: Honeywell Inc., Minneapolis, Minn.

[22] Filed: May 27, 1975

[21] Appl. No.: 580,650

[52] U.S. Cl. ..... 315/241 P; 307/252 K; 315/151; 354/145

[51] Int. Cl.[2] ..... H05B 41/32

[58] Field of Search ..... 315/241 P, 241 S, 151, 315/179, 190, 193; 307/246, 252 K, 252 M; 354/145, 147

[56] References Cited

UNITED STATES PATENTS 3,809,954 5/1974 Engelstatter ..... 315/241 P X 3,814,985 6/1974 Pecher et al. ..... 315/241 P

*Primary Examiner*—Eugene La Roche

*Attorney, Agent, or Firm*—David R. Fairbairn

[57] ABSTRACT

False triggering of the flash termination switch in a series termination electronic flash unit as a result of contact bounce is eliminated. Gating means inhibits the contacts from triggering the flash termination switch unless a voltage at a selected point in the circuit has attained a predetermined value. False triggering of the flash ignition as a result of noise present on the synchronization switch line is also inhibited.

15 Claims, 1 Drawing Figure

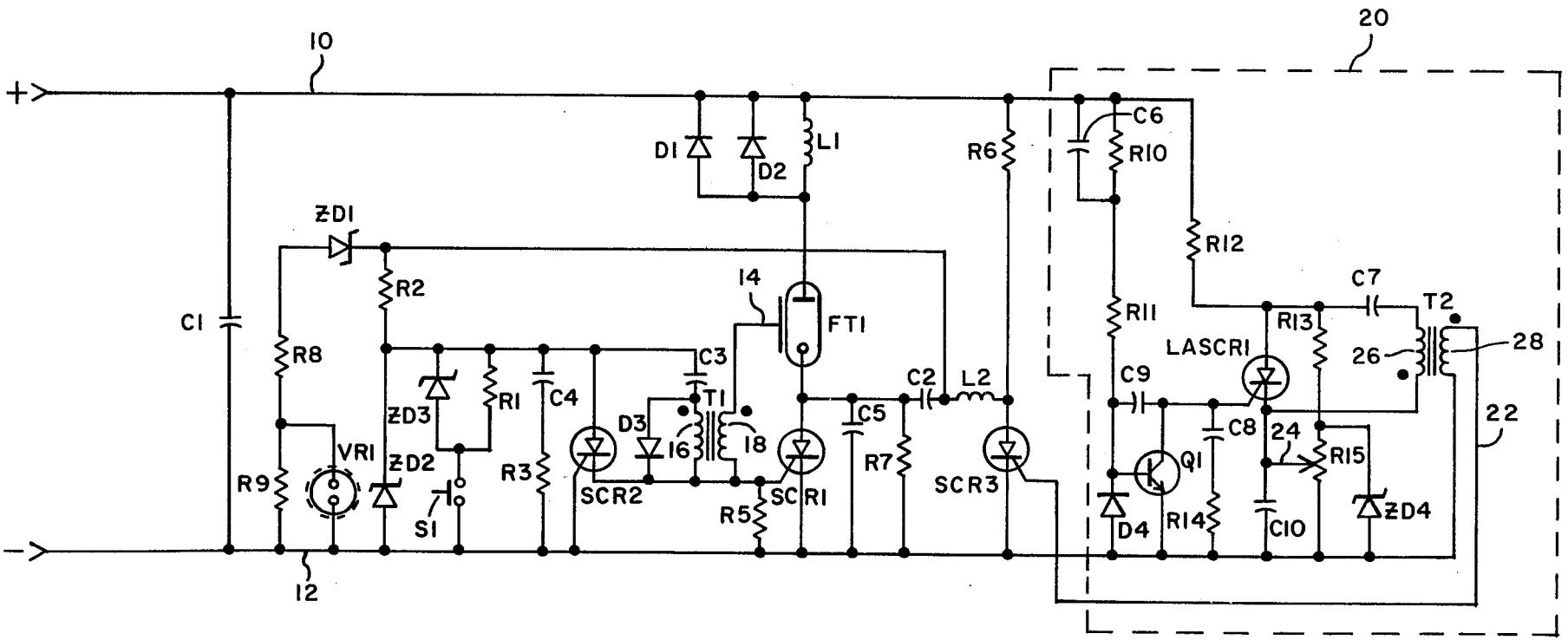
20
28
22
T2
26
C7
ZD4
R15
R13
24
C10
LASCR1
C8
Q1
R14
R12
C6
R10
R11
C9
D4
R6
L2
SCR3
C2
R7
C5
L1
FT1
SCR1
D2
14
18
R5
C3
T1
16
D1
D3
SCR2
C4
R3
R1
S1
ZD3
ZD2
R2
VR1
ZD1
10
R8
12
R9
C1
+
-

ELECTRONIC FLASH APPARATUS WITH INHIBITION OF CONTACT BOUNCE FALSE TRIGGERING

REFERENCE TO CO-PENDING APPLICATIONS

Subject matter disclosed but not claimed herein is disclosed and claimed in the following co-pending applications which are filed on even date herewith and are assigned to the same assignee as the present application: Ser. No. 580,651 entitled "Series SCR Gate Hold-on Circuit" by Robert G. McConnel; and Ser. No. 580,649 entitled "GAte Protection Circuit for Electronic Flash Apparatus" by Robert G. McConnell.

BACKGROUND OF THE INVENTION

The present invention relates generally to light controlling systems. In particular, the present invention is directed to improved electronic flash apparatus.

Electronic flash apparatus is known in the art in which the flash of light produced by a flash tube is automatically terminated after a predetermined total quantity of light has been received from the scene being illuminated. In one particular type of electronic flash apparatus, a flash termination switch is connected in series with the flash tube. When a light flash is to be produced, both the flash tube and the flash termination switch are switched to a conductive state. When an exposure control circuit has received the predetermined quantity of light, the flash termination switch is switched to a non-conductive state, thereby terminating the flash.

Immediately after termination of the flash, retriggering of the flash caused by false actuations of the flash termination switch is possible. The gas in the flash tube remains ionized for a period of time, and, if the flash termination switch is again triggered into conduction, another light flash can be produced without triggering the flash tube. Once source of this false actuation is contact bounce of the contacts which are closed by the user to initiate the flash.

SUMMARY OF THE INVENTION

The present invention eliminates the possibility of false triggering of a flash termination switch as a result of contact bounce. Gating means inhibit the triggering means from triggering the flash termination switching means to a conductive state unless a voltage at a selected point in the circuit has attained a predetermined value. In preferred embodiments, false triggering of the flash tube and flash termination switch due to x-sync noise is also inhibited.

BRIEF DESCRIPTION OF THE DRAWINGS

The FIGURE is a schematic diagram of one embodiment of electronic flash apparatus of the present invention.

DETAILED DESCRIPTION OF THE PREFERRED EMBODIMENTS

The present invention is an electronic flash apparatus of the series termination type. The apparatus of the present invention eliminates the possibility of false retriggering of the flash after termination as a result of contact bounce.

The FIGURE shows one preferred embodiment of the present invention. The electronic flash apparatus includes conductors 10 and 12. Conductor 10 is connected to a positive terminal, and conductor 12 is connected to a negative terminal.

Main flash storage capacitor C1 is connected between conductors 10 and 12. Also connected between conductors 10 and 12 is the series connection of inductor L1, flash tube FT1, and flash termination switch SCR1. As shown in the Figure, flash termination switch SCR1 may be a semiconductor switching device such as a silicon controlled rectifier. SCR1 has two main current carrying electrodes (anode and cathode) and a control electrode (gate) which controls the conductivity between the anode and cathode.

One terminal of L1 is connected to conductor 10, and the other terminal is connected to the anode of flash tube FT1. The cathode of flash tube FT1 is connected to the anode of SCR1, and the cathode of SCR1 is connected to conductor 12.

The purpose of L1 is to reduce the peak current flowing into SCR1. Diodes D1 and D2, which are connected in parallel with inductor L1, are "free wheeling" diodes which prevent a large negative voltage from being induced in L1 when SCR1 is turned off.

In order to initiate a light flash, an ignition signal must be applied to the triggering terminal 14 of flash tube FT1. In addition, SCR1 must be turned on at the same time by a signal to the gate of SCR1. These signals are produced by the circuits which include resistors R1, R2, R3, and R5, capacitors C3 and C4, contacts S1, zener diodes ZD2 and ZD3, diode D3, transformer T1, and flash trigger switch SCR2.

Resistors R2 and zener diode ZD2 are connected in series to form a voltage divider network. Connected to the junction between resistor R2 and zener diode ZD2 is one terminal of resistor R1. The other terminal of resistor R1 is connected to one terminal of contacts S1. The second terminal of contacts S1 is connected to conductor 12, so that R1 and S1 are connected in parallel with ZD2.

Zener diode ZD3 is connected in parallel with resistor R1. The zener voltage of ZD3 is less than the zener voltage of ZD2. In one preferred embodiment, the zener voltage of ZD2 is about 170 volts, and the zener voltage of ZD3 is about 100 volts.

R1 forms a noise inhibiting means preventing the false triggering of SCR2, SCR1 and FT1 from noise injected at S1. R1 has a high resistance; in one embodiment R1 is about 5 megohm.

ZD3 forms gating means which eliminate false triggering due to contact bounce by disenabling contacts S1 from triggering SCR1 and SCR2 unless a voltage at a selected point in the circuit has attained a predetermined value.

Flash trigger switch SCR2 is, like SCR1, preferably a semiconductor switching device such as a silicon controlled rectifier. SCR2 has first and second main current carrying electrodes (anode and cathode) and a control electrode (gate). The anode of SCR2 is connected to the junction of resistor R2 and zener diode ZD2, and the cathode of SCR2 is connected to the gate of SCR1. The gate of SCR2 is connected to conductor 12.

Resistor R5 is connected between the gate of SCR1 and conductor 12. The resistance of resistor R5 is selected to swamp out gate-cathode noise transients which could cause false triggering of SCR1 and SCR2.

Also connected in parallel with ZD2 is a series RC network formed by resistor R3 and capacitor C4. One terminal of resistor R3 is connected to the anode of SCR2. The other terminal of resistor R3 is connected to one terminal of capacitor C4. The other terminal of capacitor C4 is connected to conductor 12.

Transformer T1 has primary and secondary windings 16 and 18, respectively. One terminal of secondary winding 18 is connected to the flash trigger electrode 14 of flash tube FT1. The other terminal is connected to one terminal of primary winding 16 and to the cathode of SCR2. The other terminal of primary winding 16 is connected to capacitor C3. The opposite terminal of capacitor C3 is connected to the anode of SCR2. Capacitor C3 and primary winding 16, therefore, are connected in parallel with the anode to cathode current path of SCR2. Diode D3 is connected in parallel with primary winding 16.

Exposure control circuit 20, which may be one of many well known exposure control circuits used for automatic electronic flash apparatus, receives light reflected from the scene which is illuminated by the flash. When the total light received by exposure control circuit 20 exceeds a predetermined desired value, exposure control circuit 20 produces a flash termination signal at terminal 22.

The particular exposure control circuit 20 shown in the Figure is similar to the circuits described in U.S. Pat. No. 3,519,879 by F. T. Ogawa. It is understood, however, that exposure control circuit 20 may take many other forms.

A series circuit consisting of resistors R10, R11, and diode D4 is connected between conductors 10 and 12. Capacitor C6 is connected between conductor 10 and the junction of resistors R10 and R11. Capacitor C6, therefore, is connected in parallel with resistor R10.

The light sensing element of exposure control circuit 20 is a light activated silicon controlled rectifier, LASCR1. The anode of LASCR1 is connected to conductor 10 through resistor 12. The cathode of LASCR1 is connected to conductor 12 through capacitor C10. Integrating capacitor C8 and anticipation resistor R14 are connected between the gate of LASCR1 and conductor 12.

A series connection is formed between connectors 10 and 12 by resistors R12, R13, and R15. Resistor R13 is connected between the anode of LASCR1 and one terminal of resistor R15. The other terminal of resistor R15 is connected to conductor 12. Resistor R15 also has a sliding contact 24 which is connected to the cathode of LASCR1. The voltage on capacitor C10 and the cathode of LASCR1 is, therefore, determined by the position of sliding contact 24. Zener diode ZD4 is connected in parallel with resistor R15 to limit the voltage on resistor R15.

Transformer T2 has primary and secondary windings 26 and 28, respectively. One terminal of primary winding 26 is connected to the cathode of LASCR1, and the other terminal is connected to one terminal of capacitor C7. The other terminal of capacitor C7 is connected to the anode of LASCR1, thereby forming a series circuit including capacitor C7, primary winding 26, and anode - cathode of LASCR1.

One terminal of secondary winding 28 is connected to conductor 12. The other terminal 22 is connected to the gate of commutation switch SCR3. Terminal 22 applies the flash termination signal to the gate of SCR3.

Transistor Q1 normally disables circuit 20 and enables the circuit only upon the firing of FT1. Transistor Q1 has its collector electrode connected to the gate of LASCR1 and its emitter electrode connected to conductor 12. The collector - emitter current path of transistor Q1, therefore, is connected in parallel with integrating capacitor C8 and anticipation resistor R14. The base electrode of transistor Q1 is connected to the junction between resistor R11 and diode D4. Diode D4 is connected to be reverse biased when the base - emitter junction of transistor Q1 is forward biased. Finally capacitor C9 is connected between the base and collector electrodes of transistor Q1.

The Figure includes a circuit for turning off SCR1 and thus terminating the light flash in response to a flash termination signal at terminal 22. The termination circuit, which includes resistors R6 and R7, commutation capacitor C2, inductor L2, capacitor C5, and commutation switch SCR3, turns off SCR1 by the well known commutation technique.

Commutation switch SCR3 is, like SCR1 and SCR2, preferably a semiconductor switching device. SCR3 has two main current carrying electrodes (anode and cathode) and a control electrode (gate). The gate of SCR3 is connected to terminal 22 to receive the flash termination signal. The cathode of SCR3 is connected to conductor 12, and the anode of SCR3 is connected to one terminal of resistor R6. The other terminal of resistor R6 is connected to conductor 10. Commutation capacitor C2 and inductor L2 are connected in series between the anodes of SCR1 and SCR3. Resistor R7 and capacitor C5 are both connected between the anode and cathode of SCR1.

Resistor R2 is connected to the junction of inductor L2 and commutation capacitor C2. The charging of capacitors C3 and C4, therefore, is dependent upon the charging of capcitor C2. Since zener diode ZD2 is connected in parallel with RC network R3 – C4 and also with contacts S1 and resistor R1, ZD2 limits the voltage on capacitors C3 and C4 to a value which is less than the full voltage on commutation capacitor C2.

An indicator circuit including zener diode ZD1, resistors R8 and R9, and neon indicator lamp VR1 is connected to sense the voltage on commutation capacitor C2. One terminal of zener diode ZD1 is connected to the junction of inductor L2 and commutation capacitor C2. The other terminal of zener diode ZD1 is connected to a voltage divider circuit formed by resistors R8 and R9. One terminal of resistor R9 is connected to conductor 12.

Indicator VR1, which is connected in parallel with resistor R9, only emits light when a predetermined voltage is on commutation capacitor C2. This predetermined voltage is determined by the zener voltage of ZD1 and the values of resistors R8 and R9. The predetermined voltage has been selected so that communication capacitor C2, as well as capacitors C3 and C4, have the necessary voltage to produce proper operation of the circuit. Indicator VR1 goes out at the initiation of commutation, and does not turn back on and emit light until both main capacitor C1 and commutation capacitor C2 are charged to the predetermined voltage.

The operation of the circuit shown in the FIGURE is generally as follows. Initially, main storage capacitor C1 is charged to a relatively high voltage (generally about 360 volts) by the usual capacitor charging means (not shown but well known in the art). Commutation capacitor C2 has a much lower value than main capacitor C1, and thus charges to the voltage on C1 through the charging circuit formed by resistors R6 and R7 and inductor L2. With voltage on commutation capacitor C2, capacitor C4 charges via resistors R6, R2, and R3 to a voltage limited by zener diode ZD2. Similarly, capacitor C3 charges via resistors R6 and R2, primary winding 16, and resistor R5 to the same voltage as capacitor C4.

Voltage indicator VR1 senses the voltage level on commutation capacitor C2 and turns on when the voltage divider formed by ZD1, R8, and R9 senses that the voltage level of C2 has exceeded a predetermined value. In one preferred embodiment, this predetermined value is about 300 volts. Indicator VR1 turns on and emits light, thereby indicating that the apparatus is ready for operation.

At this time, transistor Q1 is turned on, thereby causing the collector-emitter current path to effectively short circuit capacitor C8 and resistor R14. LASCR1, therefore, is held in an "off" or non-conductive state. As a result, sensing circuit 20 is disabled so that commutation switch SCR3 is not prematurely actuated by extraneous causes.

To initiate a flash, contacts S1 are closed. Current flows out off capacitor C3, through zener diode ZD3, through contacts S1, from gate to cathode of SCR2 and through primary winding 16 to capacitor C3. The time required to turn on SCR2 is rather short (typically about 1 microsecond) and, therefore, C3 does not dissipate much energy until SCR2 turns on. At that time, C3 dumps its charge through SCR2 anode-to-cathode and into primary winding 16. The voltage induced in secondary winding 18 is applied to triggering electrode 14 of FT1 to turn FT1 on.

With SCR2 on, a discharge path is established for charge stored on capacitor C4. It discharges through a current path including SCR2 anode-to-cathode, SCR1 gate-to-cathode, and resistor R3. The discharge of capacitor C4 into the gate of SCR1 turns SCR1 on. The time constant of C4 and R3 is selected so that gate current is maintained on SCR1 until sufficient current is available through flash tube FT1 to keep SCR1 in conduction.

The reduction in voltage between conductors 10 and 12 caused by the conduction of FT1 and SCR1 causes transistor Q1 to turn off. This enables light sensing circuit 20.

LASCR1 starts to receive light from the scene as a result of the operation of flash tube FT1. LASCR1 produces photocurrent which is proportional to the intensity of the incident light. This photocurrent flows through integrating capacitor C8 and resistor R14 and begins to charge capacitor C8.

As light continues to be received by LASCR1, the voltage on the gate of LASCR1 increases. When the gate trigger voltage of LASCR1 is exceeded, LASCR1 is switched into conduction. Capacitor C7 dumps its charge through the anode-cathode current path of LASCR1 and into primary winding 26 of transformer T2. This produces a voltage pulse in secondary winding 28 which is applied through terminal 22 to the gate of commutation switch SCR3.

When commutation switch SCR3 is turned on, commutation capacitor C2 is charged through L2, anode-to-cathode of SCR3, C1, L1, and FT1. This causes a reduction in voltage at the anode of SCR1 and turns off SCR1, thereby terminating the flash.

When commutation is initiated, indicator VR1 goes out. It does not turn on again until both the main capacitor C1 and the commutation capacitor C2 are charged to greater than a predetermined value. Indicator VR1, therefore, gives an accurate indication of when the circuit is again ready to operate properly.

Immediately after termination of the flash, retriggering of the flash caused by false actuation off SCR1 is possible. The gas in flash tube FT1 is still ionized and, if SCR1 were once again triggered into conduction, another light flash could be produced without requiring a triggering signal at triggering terminal 14 of FT1.

The present invention eliminates the possibility of false triggering of SCR1 caused by contact bounce of contacts S1. Once FT1 is initially in conduction, capacitors C3 and C4 are practically discharged. In order to retrigger SCR1 as a result of contact bounce after SCR1 has turned off, capacitors C3 and C4 must charge via resistors R6 and R2 to a voltage greater than the zener voltage of zener diode ZD3. C3 and C4 cannot charge until after SCR3 is turned off (in other words, commutation is complete) because SCR3, when turned on, effectively removes the voltage source for charging C3 and C4. Once SCR3 turns off, C3 and C4 can recharge via resistor R6 and R2. Resistor R2, however, has been chosen to have a value such that the time required to charge C3 and C4 to greater than the zener voltage of ZD3 is long, typically about 0.2 seconds. This charging time is much longer than the ordinary duration of contact bounce. Contact bounce problems, therefore, are eliminated since triggering cannot occur during the time that the contacts are bouncing.

Resistor R1 effectively eliminates false triggering of the flash tube FT1 due to noise injected in series with the contacts S1. S1 is, in many embodiments, remotely located on the end of a cord at the camera site. Noise is often induced in the form of power line transients or various means to cause undesirable triggering of the flash unit. Resistor R1, by maintaining a voltage at the junction of R1, S1 approximately equal to the zener voltage of ZD2, requires that the voltage at the junction of R1, S1, ZD3 be reduced by the zener voltage of ZD3, before any current can flow through ZD3 to cause SCR2 to trigger. Therefore, injected noise of less magnitude than the reverse breakdown voltage of ZD3 is inhibited from triggering the flash unit.

Although the present invention has been described with reference to a series of preferred embodiments, workers skilled in the art will recognize that changes may be made in form or detail without departing from the spirit and scope of the invention. For example, although the gating means is preferably a zener diode connected in series with the contacts, the gating means can take other forms as well. The gating means of the present invention inhibits the contacts from triggering the flash termination switch unless a voltage at a selected point in the circuit has attained a predetermined value. Although the particular circuit shown in the Figure utilizes a particular point in the circuit, workers skilled in the art will recognize that other voltages within the circuit can be sensed and the operation of the contacts be controlled as a function of the voltages at one of those other points.

The embodiments of the invention in which an exclusive property or right is claimed are defined as follows:

1. In electronic flash apparatus including flash tube means for producing light; first switching means connected in series with the flash tube means, the first switching means having first and second main current carrying electrodes and a control electrode; second switching means having first and second main current carrying electrodes and a control electrode, the second switching means for triggering the flash tube means and the first switching means; the second switching means adapted to be connected to contact means for triggering the second switching means; the improvement comprising:

gating means connected in series with the contact means and the second switching means for disenabling the contact means from triggering the second switching means unless a voltage at a selected point exceeds a predetermined value.

2. The invention of claim 1 wherein the gating means comprises first zener diode means in series with the contact means and the second switching means.

3. The invention of claim 2 and further comprising resistor means in parallel with the first zener diode means.

4. The invention of claim 3 and further comprising second zener diode means in parallel with the contact means and the first zener diode means.

5. The invention of claim 2 and further comprising:

capacitor means for supplying the current to trigger the first switching means; and charging means for charging the capacitor means.

6. The invention of claim 5 wherein the voltage at the selected point is determined by the voltage on the capacitor means.

7. The invention of claim 6 wherein the charging means has a charging time for charging the capacitor means whereby the time required for the voltage at the selected point to exceed the predetermined value is greater than a contact bounce time period.

8. In electronic flash apparatus including flash tube means for producing light in response to an ignition signal; flash termination switching means connected in series with the flash tube means for switching from a conductive to a non-conductive state to terminate a light flash; and triggering means including contact means and capacitor means for triggering the flash tube means and the flash termination switching means; the improvement comprising:

gating means connected in series with the contact means and the capacitor means for inhibiting the triggering means from triggering the flash termination switching means to a conductive state unless a voltage at a selected point has attained a predetermined value.

9. The invention of claim 8 wherein the gating means comprises first zener diode means in series with the contact means and the capacitor means.

10. The invention of claim 9 and further comprising resistor means in parallel with the first zener diode means.

11. The invention of claim 10 and further comprising second zener diode means in parallel with the contact means and the first zener diode means.

12. The invention of claim 8 and further comprising:

charging means for charging the capacitor means.

13. The invention of claim 12 wherein the voltage at the selected point is determined by voltage on the capacitor means.

14. The invention of claim 13 wherein the capacitor means is discharged during the light flash and wherein substantial charging of the capacitor means by the charging means occurs only after termination of the light flash.

15. The invention of claim 14 wherein the charging means has a charging time for charging the capacitor means to attain the predetermined value which is greater than a contact bounce time period.

* * * * *